United States Patent [19]

Palenik, III

[11] 3,987,579

[45] Oct. 26, 1976

[54] FREE-FORM CONSTRUCTION AMUSEMENT DEVICE

[76] Inventor: Joseph A. Palenik, III, 3431 W. 53rd Place, Chicago, Ill. 60632

[22] Filed: June 9, 1975

[21] Appl. No.: 584,715

[52] U.S. Cl. ..... 46/16; 46/27; 46/29; 46/31

[51] Int. Cl.[2] ..... A63H 33/08

[58] Field of Search ..... 46/16, 17, 27, 29, 23, 46/25, 30

[56] References Cited

UNITED STATES PATENTS

| | | | |
|---|---|---|---|
| 1,916,634 | 7/1933 | Pajeau | 46/29 |
| 2,843,970 | 7/1958 | Keuls | 46/16 |
| 2,871,619 | 2/1959 | Walters | 46/30 X |
| 2,996,832 | 8/1961 | Rubin | 46/16 |
| 3,518,787 | 7/1970 | Angello, Sr. et al. | 46/31 X |
| 3,546,807 | 12/1970 | Howe | 46/16 |
| 3,625,149 | 12/1971 | Allen | 46/16 |

*Primary Examiner*—Louis G. Mancene
*Assistant Examiner*—Robert F. Cutting
*Attorney, Agent, or Firm*—David D. Kaufman

[57] ABSTRACT

A kit-type game or amusement device having a foundation board, building blocks and connector rods. The board and blocks have holes formed therein adapted to frictionally receive the rods, and the spacing between adjacent holes on both are related. The relationship makes possible the construction of an almost limitless variety of free-form structures.

7 Claims, 5 Drawing Figures

28
26
24
U
20
30
13
22

36
42
44
½U
32
38
2U
34
15
40

17

10

48
46
24a

FREE-FORM CONSTRUCTION AMUSEMENT DEVICE

This invention relates to amusement devices and more particularly to devices of the building kit type having a few basic building blocks with which a variety of forms may be constructed.

Applicant is aware that there are already many building kit amusement devices in existence. They range from the simplest aimed at very young children, such as those having only one building block form which can be connected to another block only in a single manner, to the highly sophisticated having a great many different pieces which may be constructed into complex structures of even a semi-permanent nature.

Applicant also is aware that the specific attributes of such amusement devices are related to the primary purpose for which the device is designed. Thus, the number of pieces, variety of pieces, manner of connecting pieces together, types of structures which can be built, and the variety of structures possible will vary depending upon whether the kit is designed to educate, test manual dexterity and ingenuity or, simply entertain. Of course, the ability to entertain or amuse is related directly to the number of combinations and structures which are possible with the kit.

It is the principal object of this invention to provide a construction amusement device having a limited number of different building blocks or pieces but which nonetheless may be built into an almost endless variety of forms. A related object is to provide such an amusement device in which the structures or arrangements of parts which can be built are visual and free-form rather than functional.

Another object of the invention is to provide a free-form construction amusement device of the character described in which the construction operations are simple to understand and accomplish, requiring no tools or adhesives, but the variety of structures achievable is nonetheless limited only by the creativity of the user.

A further object is to provide a free-form construction amusement device of the character described which is portable and lightweight and may be used on any supporting surface.

Still another object is to provide a free-form construction amusement device of the character described which is completely modular so that a second or additional kits may be coupled to a first kit to thereby multiply the amusement possibilities.

Yet a further object is to provide a free-form construction amusement device of the character described which may be inexpensively made employing simple basic forms and common materials but which is nevertheless capable of affording continuing entertainment to the user and also withstanding hard use or abuse.

With the foregoing and other objects in view which will appear as the description proceeds, the invention comprises generally a foundation board having a grid of holes formed therein and arranged in rows and columns with uniform spacing between adjacent holes. The board may also contain a second series of holes arranged in rows and columns with unit spacing, but in which each hole is spaced one unit from an adjacent hole in the first set of rows and columns. Associated with the board are a plurality of pieces or building blocks which may be of diverse three-dimensional geometric forms such as cubes, rectangles, rhomboids, triangles, and the like. Each of the blocks has one or more holes formed in at least two sides thereof, and the holes in any given side are spaced apart either one-half of the unit spacing of the board holes or a whole number multiple thereof. The kit also includes a plurality of elongated posts or rods of varying lengths and adapted to be frictionally received at either end in the board and building block holes, whereby free-form structures of almost limitless combinations may be built.

For the purpose of facilitating an understanding of my invention, I have illustrated in the accompanying drawings a preferred embodiment thereof, from an inspection of which, when considered in connection with the following description, its mode of construction, assembly and operation, and many of its advantages should be readily understood and appreciated.

Referring to the drawings in which the same reference characters are employed to indicate corresponding or similar parts throughout the several figures of the drawings.

Figures 1, 2, 3, 4, 5:
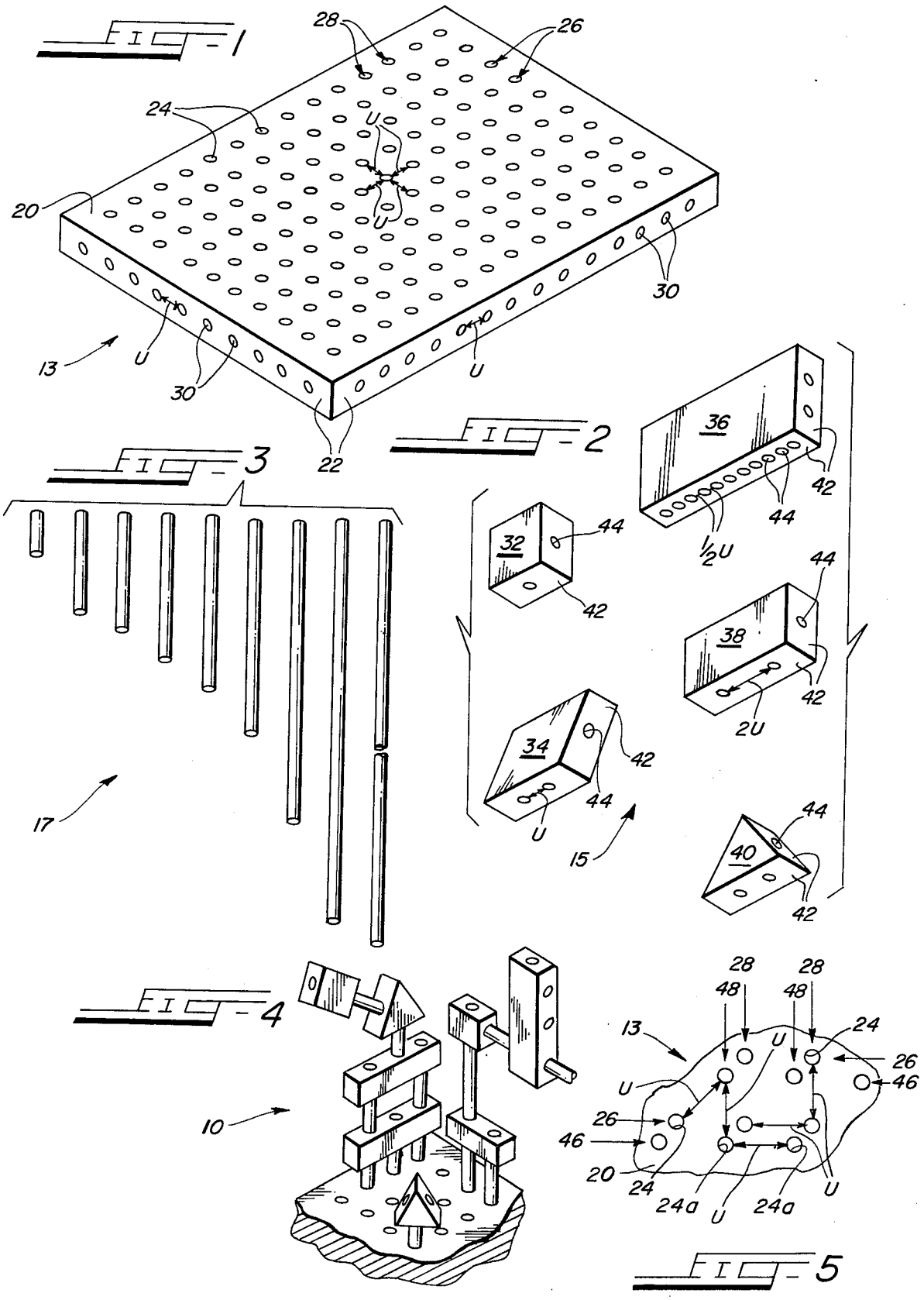
FIG. 1 is an isometric view of a foundation board made in accordance with the principles of the invention.
FIG. 2 is an isometric view of a representative group of building blocks made in accordance with the principles of the invention.
FIG. 3 is a perspective view of the connector rods.
FIG. 4 is a fragmentary perspective view illustrating a representative manner in which a structure may be built.
FIG. 5 is a fragmentary plan view of a modified form of foundation board.

Referring now with greater particularity to the drawings, it will be seen that the numeral 10 indicates generally a construction amusement device embodying the principles of the invention. The device 10 is a kit which comprises three basic parts, a foundation board 13, building blocks 15 and connector rods 17.

Foundation board 13 comprises a relatively thin, rectangular board having a top surface 20 and sides 22. A plurality of holes 24 is formed in the top surface 22. The holes 24 are arranged in parallel rows 26 and parallel columns 28 perpendicular to said rows, and it will be noted that there is uniform spacing U between adjacent holes. A plurality of holes 30 is also formed in the sides 22 and they are in alignment with the rows 26 and columns 28 and thus uniformly spaced apart the distance U.

The building blocks 15 comprise a plurality each of basic three-dimensional forms, such as, cubes 32, rhombic parallelepipeds 34, rectangular parallelepipeds 36 and 38, and triangular prisms 40. Each of the building blocks 15 comprises a plurality of sides 42 having formed therein one or a plurality of holes 44. Adjacent holes 44 on any side 42 are spaced apart a distance of ½U or a whole number multiple of U, such as, 1U, 2U, etc., as indicated in FIG. 2 of the drawings.

Completing the device 10 is a plurality each of varying length connector rods 17. Each connector rod 17 is adapted to be frictionally received, at either end, in any of the holes 24, 30 and 44.

To build a free-form structure with the device 10, it is simply necessary to insert connector rods 17 into foundation board holes 24 and insert the opposite ends of said rods into holes 44 of building blocks 15. Additional rods 17 are then inserted into the holes 44 of the connected building blocks and additional building blocks connected to those rods, and so on further in any desired random fashion, as illustrated in FIG. 4 of the drawings. Owing to the spacing relationship between the foundation board holes 24 and the building block holes 44, it will be appreciated that any positioning of two or more rods 17 on the board will find a mating response in the holes 44 of a building block. It should likewise be appreciated that, although not illustrated, the side holes 30 of the board 13 may also be utilized in the building of free-form structures. Similarly, the holes 30 may be employed to connect together two or more boards 13 in modular fashion.

A modification of the board 13 is illustrated in FIG. 5. Here, the board 13 is provided with additional holes 24a arranged in a second set of parallel rows 46 and parallel columns 48 perpendicular to said rows, having uniform spacing U between adjacent holes. It will be noted, however, that the rows 46 and columns 48 are spaced intermediate the rows and columns 26 and 28 so that the angular distance between each hole 24a and an adjacent hole 24 is equal to U. This arrangement increases the possible combinations and positions of rods 17 on the board 13, thereby further increasing the variety of structures which may be built with the device.

The forms of building blocks 15 illustrated and described herein comprise a family of geometric prisms which are illustrative of the types of pieces which may be employed. It will thus be appreciated that the invention contemplates as well the use of other forms, such as, cylinders, cones, pyramids, and the like.

What I claim is:

1. A construction amusement device of the character described comprising:

a foundation board having a plurality of holes formed therein, said holes being arranged in rows and columns with unit spacing between adjacent holes;

a plurality of blocks having one or more holes formed in at least two sides thereof, adjacent holes on any one of said sides being spaced apart one-half unit or a whole number multiple of said unit; and a plurality of connector rods each adapted to be received at either end thereof in any of said holes, whereby said blocks with a plurality of holes in their sides may be connected with two or more rods to the board or to another block.

2. The construction amusement device of claim 1 and comprising further additional holes formed in said board and arranged in a second set of rows and columns with unit spacing between adjacent holes, the holes of said second set of rows and columns being positioned so that the spacing between each of them and an adjacent hole in the first set of rows and columns is equal to one of said units.

3. The construction amusement device of claim 1 in which each of said blocks comprises a three-dimensional form whose narrowest side is wider than the diameter of said holes, and at least two opposed sides of said block have holes formed therein.

4. The construction amusement device of claim 3 in which said blocks comprise forms of geometric prisms and each side of said prisms has one or more holes formed therein.

5. The construction amusement device of claim 1 in which said rods comprise a plurality of lengths and a plurality of rods each of said lengths.

6. The construction amusement device of claim 1 and comprising further holes formed in one or more of the sides of said foundation board and adapted to receive said rods therein, whereby two or more of said boards may be connected together in modular fashion.

7. The construction amusement device of claim 6 in which adjacent ones of said last-mentioned holes have unit spacing therebetween.

* * * * *